US005515627A

United States Patent [19]

McCabe

[11] Patent Number: 5,515,627

[45] Date of Patent: May 14, 1996

[54] APPARATUS AND METHOD FOR FEEDING FLATWORK ARTICLES

[76] Inventor: Stanley G. McCabe, 4404 89th, Lubbock, Tex. 79424

[21] Appl. No.: 281,484

[22] Filed: Jul. 27, 1994

[51] Int. Cl.[6] ..... D06F 67/04

[52] U.S. Cl. ..... 38/143

[58] Field of Search ..... 38/143; 198/574, 198/575, 604, 605, 626.1, 626.5, 626.6

[56] References Cited

U.S. PATENT DOCUMENTS

| | | | |
|---|---|---|---|
| 3,376,036 | 4/1968 | Weir | 271/54 |
| 3,421,756 | 1/1969 | Weir | 271/79 |
| 3,464,131 | 9/1969 | McCabe | 38/143 |
| 3,509,650 | 5/1970 | Orkney et al. | 38/143 |
| 3,657,832 | 4/1972 | Valentine | 38/143 |
| 3,772,808 | 11/1973 | Behn | 38/143 |
| 3,807,068 | 4/1974 | Ross | 38/143 |
| 3,911,604 | 10/1975 | Sjostrom | 38/143 |
| 4,031,639 | 6/1977 | McCabe et al. | 38/143 |
| 4,106,227 | 8/1978 | Allen et al. | 38/143 |
| 4,299,521 | 11/1981 | Jensen | 414/13 |
| 4,313,269 | 2/1982 | van Rumpt et al. | 38/143 |
| 4,327,510 | 5/1982 | Grantham | 38/8 |
| 4,345,391 | 8/1982 | Weir | 38/143 |
| 4,553,662 | 11/1985 | Jensen | 198/456 |
| 4,967,495 | 11/1990 | Weir | 38/143 |
| 5,168,645 | 12/1992 | Robin et al. | 38/143 |
| 5,169,282 | 12/1992 | Ueda et al. | 414/786 |
| 5,172,502 | 12/1992 | Kober | 38/7 |
| 5,179,795 | 1/1993 | Nakamura et al. | 38/143 |
| 5,416,992 | 5/1995 | Ueda et al. | 38/143 |

FOREIGN PATENT DOCUMENTS

| | | | |
|---|---|---|---|
| 0011403A1 | 5/1980 | European Pat. Off. | D06F 67/04 |
| 0554205A1 | 8/1993 | European Pat. Off. | D06F 67/04 |
| 0554204A1 | 8/1993 | European Pat. Off. | D06F 67/04 |
| 0609945A1 | 8/1994 | European Pat. Off. | D06F 67/04 |
| 2211100 | 9/1987 | Japan | 38/143 |
| 2219313 | 12/1989 | United Kingdom | 38/143 |
| 2221226 | 1/1990 | United Kingdom | 38/143 |

OTHER PUBLICATIONS

Brochure: Central® Centrafeed Duo–High capacity, two–operator, ergonomic, large–piece feeder with a totally new feeding concept: One grip–no clamps (no date available).

*Primary Examiner*—Ismael Izaguirre

*Attorney, Agent, or Firm*—Willian Brinks Hofer Gilson & Lione; L. Ann Fitzgerald; John R. Crossan

[57] ABSTRACT

An apparatus and method are provided for transferring a flatwork article. A transfer mechanism grips a leading edge portion of the article between leading corner portions thereof and moves the article from a loading station to a pickup station. A positioning device locates a trailing edge portion of the article at the pickup station for engagement with a moving mechanism. A moving mechanism picks up the trailing edge portion of the article at the pickup station and moves the article to a desired location.

36 Claims, 12 Drawing Sheets

APPARATUS AND METHOD FOR FEEDING FLATWORK ARTICLES

BACKGROUND OF THE INVENTION

The present invention relates generally to flatwork article feeding machines, and more particularly, to an apparatus and method for transferring a sheet of laundry from a loading station to a pickup station where the sheet is engageable by a moving mechanism.

In commercial laundry facilities, laundry articles such as bed sheets, table linens, blankets, or the like are typically fed into a flatwork ironer and automatic folder after they are washed. The flatwork ironer dries and irons the wet sheets and the automatic folder folds and cross-folds the sheets into a neat package for use in hotels, hospitals, or the like. In order to obtain a neatly folded, unwrinkled package, it is important that the sheet be presented to an ironer and/or folder with no wrinkles or folds and with the leading edge square. In the past, operators have been employed to manually spread the sheet apart and place it in the ironer by hand. However, the use of operators tends to slow the output of the ironer and can lead to inaccurate and inconsistent placement of the sheet in the ironer. In addition, accurate placement of the sheet depends on the skill of the operators, the operators can become fatigued, and utilizing multiple operators increases costs. To overcome this difficulty, modern laundry facilities use automatic spreader-feeder machines to allow more rapid and accurate feeding of the sheets into the ironer.

These spreader-feeder machines typically include a continuously moving feed conveyor on which the sheets are automatically laid with their leading edges perpendicular to the conveyor belts. In order to position the sheet for placement onto the conveyor, a pair of spreading clamps are typically employed to grip opposing top corners of the sheet. The spreading clamps are then moved apart by one or more endless belts or cables to spread the sheet in front of the conveyor. Once the sheet is spread to the desired position, the spreading clamps release the corners of the sheet and the upper portion of the sheet is forced onto the conveyor. The conveyor then advances the sheet to the ironer or other processing equipment. Various machines of this general type are disclosed in U.S. Pat. No. 4,106,227 to Allen et al. and U.S. Pat. Nos. 4,967,495, 4,345,391, 3,421,756, and 3,376,036 to Weir.

One disadvantage of many spreader-feeder machines is the time required for an operator to load the sheet. Typically, an operator has to pick up a loose sheet from a pile, locate one or two corner portions of the sheet, and manually clamp the corner portions to the spreading clamps. This time consuming task limits the speed at which the sheets can be loaded and fed to an ironer. To increase output, some spreader-feeder machines are designed to accommodate multiple operators at different loading stations. One way to provide multiple loading stations is to include a plurality of sets of spreading clamps as disclosed in the '227 patent to Allen et al. Another way is to provide a transfer mechanism which transfers the sheets from multiple loading stations to a single pair of spreading clamps. For example, the machine disclosed in the '036 patent to Weir includes clips mounted on arms which swing laterally from an outer position to a center position where the spreading clamps pick up the sheet. In these types of machines, however, the operators still have to locate the corner portions of the sheet for insertion into a pair of clamps. Although these machines increase output, their efficiency is still dependent on the manipulation of the sheets by one or more operators. Thus, it is desirable to provide a spreader-feeder machine which increases the speed at which a sheet can be loaded by eliminating the need to precisely manipulate the sheets. More particularly, it is desirable to provide a machine which obviates the need for an operator to locate and manually clamp a corner portion of a sheet.

Attempts have been made to provide a spreader-feeder machine which does not require an operator to locate and manually clamp the corner portions of a sheet. For example, U.S. Pat. Nos. 4,031,639 and 3,464,131 to McCabe et al. disclose spreader-feeder mechanisms including a plurality of spreader belts which diverge to spread the sheet for placement on the feed conveyor. To load the sheet, an operator locates the leading edge of the sheet and places a center portion on the spreader belts. One disadvantage of this type of machine is the difficulty in keeping the leading edge of the sheet square with the feed conveyor. If the center portion of the sheet is not laid properly on the spreader belts, the sheet tends to spread unevenly. Moreover, additional operators may be required to be correct unevenly spread sheets. Other machines utilizing diverging belts to spread the sheet without clamps are disclosed in U.S. Pat. Nos. 3,772,808 to Behn and 3,807,068 to Ross. Yet another type of laundry feeder machine is disclosed in U.S. Pat. No. 4,327,510 to Grantham. To load the sheet, an operator locates the corner portions of a sheet and drapes the sheet across two V-belts. The laundry article is then spread by a blade member which is mounted between the two V-belts for admission to an ironer. Although the foregoing machines do not require manual clamping of the corner portions of the sheets, they still require an operator to precisely load the sheet to obtain an accurate spreading of the sheet.

Thus, it is desirable to provide an apparatus which increases the speed at which a sheet can be loaded. More particularly, it is desirable to provide a machine which obviates the need for an operator to locate a corner portion or the side edge of a sheet. Moreover, it is desirable to provide a spreading mechanism which accurately spreads the sheet without requiring an operator to precisely load the sheet.

SUMMARY OF THE INVENTION

Briefly stated, the invention is directed to an apparatus and method for transferring a flatwork article such as a sheet of laundry for subsequent placement on a feed conveyor. A transfer mechanism is provided to grip a leading edge portion of the article between leading corner portions thereof and move the article from a loading station to a pickup station. A positioning device is provided to locate a trailing edge portion of the article at the pickup station for engagement with a moving mechanism. In addition, a moving mechanism is provided for picking up the trailing edge portion of the article at the pickup station and moving the article to a desired location. Thus, an operator need only locate a leading edge portion of the sheet for engagement with the transfer mechanism. Rather than requiring the operator to locate the corner portions of the sheet for clamping to the moving mechanism, the present invention automatically locates the trailing edge portion of the sheet for pickup by the moving mechanism.

In a preferred embodiment of the invention, the transfer mechanism includes a delivery conveyor belt extending between the loading station and the spreading station. The delivery belt is wrapped around a forward roller positioned at the loading station and a rear roller positioned at the pickup station. To allow side portions of the sheet to hang downwardly from the delivery belt, the width of the delivery belt is less than the width of the sheet. Thus, an operator can load the sheet onto the delivery belt by placing a central portion of the sheet onto the belt.

Also preferably, a pair of positioning members are located adjacent opposite sides of the conveyor belt at a rear end thereof such that the overhanging side portions of the sheet rise and pass over the positioning members. The positioning members are preferably separate rollers located adjacent the ends of the rear roller, but can be configured as end portions of the rear roller which extend laterally beyond the width of the conveyor belt. The use of a relatively narrow conveyor belt in conjunction with the positioning members obviates the need for an operator to locate and manually clamp the corner portions of the sheet to the moving mechanism.

A holding device is also configured to clamp the trailing corner portions of the sheet against the positioning rollers to thereby locate the trailing corner portions for engagement with the moving mechanism. Preferably, the holding device includes a pair of holding rollers positioned to cooperate with the positioning rollers to allow the sheet to pass therebetween. The holding rollers and positioning rollers are operatively engageable by respective clutch and brake mechanisms or other means to stop rotation of the rollers when the trailing corner portions of the sheet are located therebetween. Thus, when the sheet has moved from the loading station to the pickup station, the holding device clamps the trailing corner portions of the sheet for pickup by the moving mechanism. Preferably, the clutch mechanisms are adapted to independently stop rotation of cooperating rollers in order to hold one trailing corner portion in advance of the other corner portion. Thus, the trailing corner portions of the sheet are automatically located regardless of how straight the operator initially places the sheet on the delivery belts.

The moving mechanism includes a first pair of clamps configured to releasably grip the trailing corner portions of the sheet from the holding rollers. The first pair of clamps are adapted to move the sheet toward the feed conveyor to a spreading position, where a second pair of clamps releasably grip the trailing corner portions of the sheet. The second pair of clamps then spread the sheet for subsequent placement onto the feed conveyor.

The present invention provides significant advantages over other feeder machines. By automatically locating the trailing corner portions of the sheet for pickup by a moving mechanism, an operator does not have to locate the side edge or the corner portions of the sheet. Moreover, the operator does not have to manually clamp the corner portions directly to a pair of clamps, or locate and press a conventional button or the like to initiate processing of the sheet. The independent clamping of the trailing corner portions also allows the operator to throw the sheet onto the delivery belts without being concerned whether the leading edge is crooked or straight. Thus, a simple, compact loading and transferring apparatus is provided which increases the speed at which a single operator can load sheets for accurate placement onto a feed conveyor.

The present invention, together with further objects and advantages, will be best understood by reference to the following detailed description taken in conjunction with the accompanying drawings.

DETAILED DESCRIPTION OF THE PREFERRED EMBODIMENTS

Figure 1:
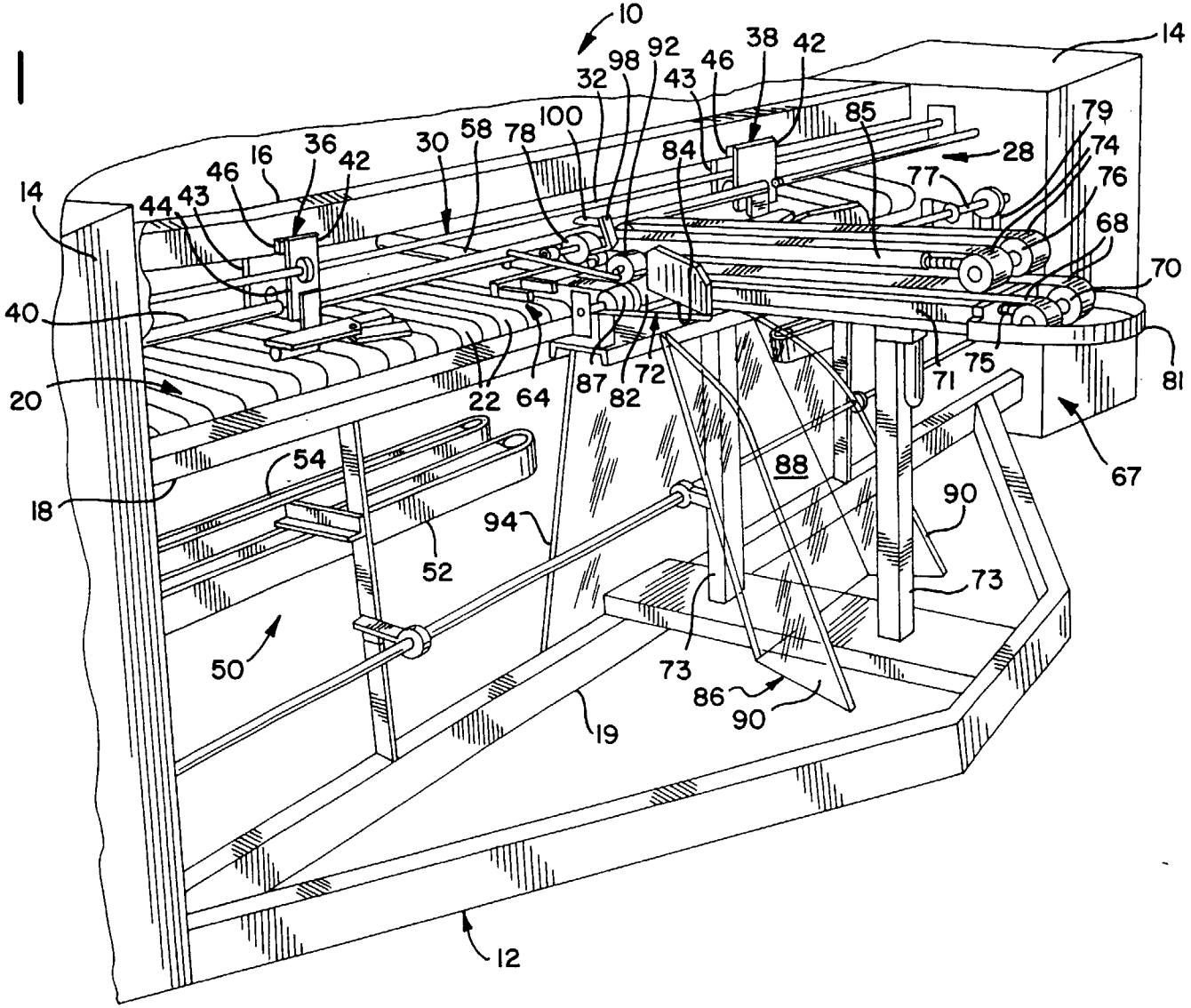
FIG. 1 is a perspective view of the present invention.
Figure 2:
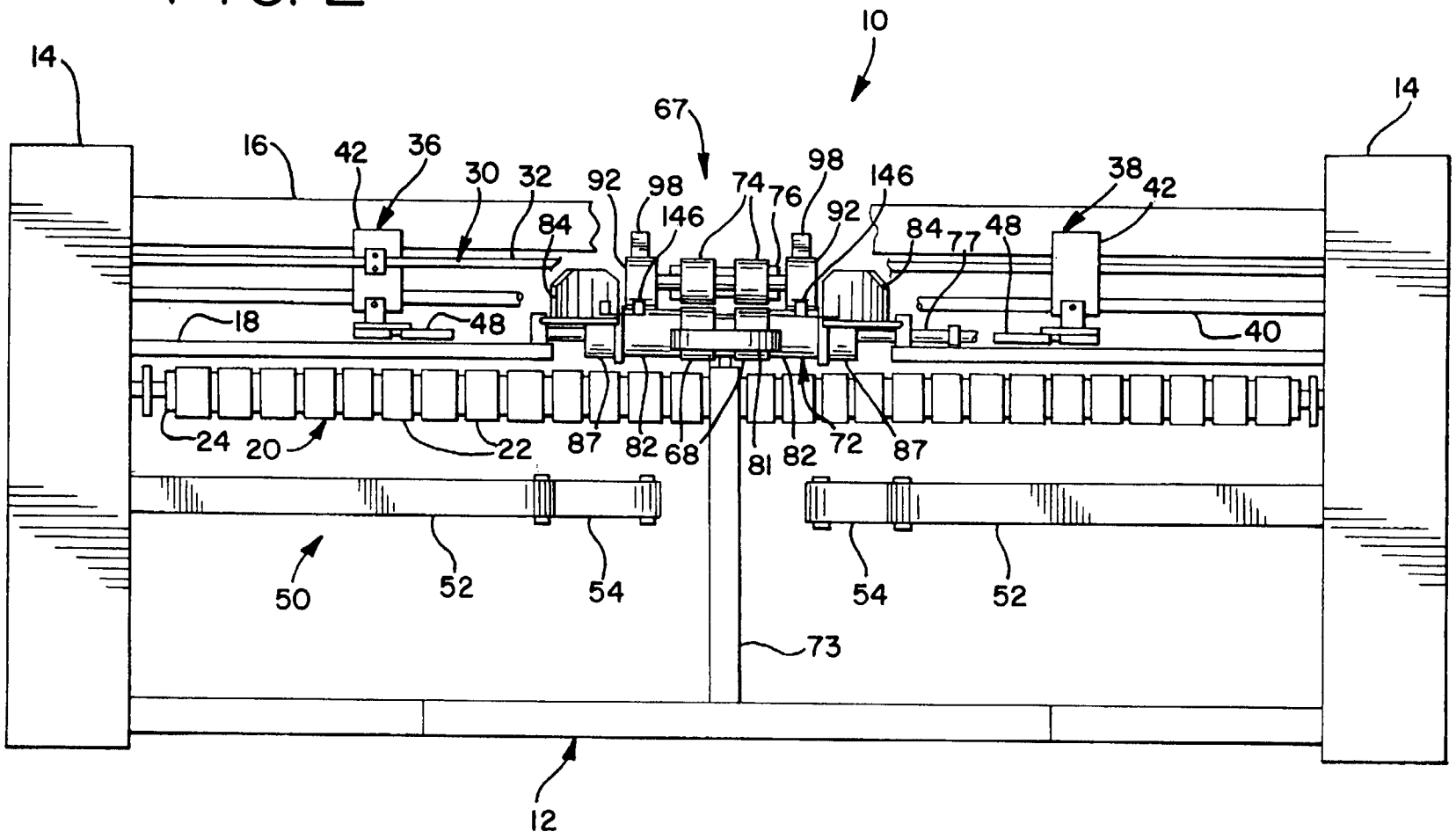
FIG. 2 is a front view of the invention shown with various components removed for clarity.

Referring to the drawings, FIGS. 1–4 show a preferred embodiment of a transfer, spreader, and feeder apparatus indicated generally at 10. The apparatus 10 includes a frame structure 12 having vertical side walls 14 with a horizontal top cross-member 16, front cross-member 18, and bottom cross-member 19 extending therebetween. A feed conveyor 20 extends horizontally between the side walls 14 and behind the front cross-member 18. The feed conveyor 20 includes a plurality of spaced apart, flexible endless belts 22 which extend around a front roller 24 and a rear roller 26. The front roller 24 is preferably driven through an endless belt by a ½ HP (0.374 KW, electric motor (not shown), and the rear roller 26 is an idler roller. The belts 22 are driven in a direction such that the upper runs of the belts 22 move rearwardly and the lower runs move forwardly. When a sheet is fed onto the feed conveyor 20, it is advanced rearwardly to a flatwork ironer and automatic folder (not shown).

To spread a sheet for placement onto the feed conveyor 20, an upper spreader mechanism 28 is located above and in front of the feed conveyor 20. The spreader mechanism 28 includes an elongated endless member 30 extending horizontally between the side walls 14 of frame 12. The endless member 30 has front and rear legs 32 and 34 which are parallel to each other in a horizontal plane and extend around an idler pulley and a drive pulley (not shown). The pulleys are rotatably mounted to the exterior of the side walls 14 and the endless member 30 extends through corresponding openings in the side walls 14. Preferably, the endless member 30 is in the form of a toothed belt, although other types of belts or chains can be used. The endless member 30 is driven through the drive pulley by a 3-phase AC squirrel cage motor with an inverter unit (not shown). An inverter unit of this type is manufactured by Mitsubishi Corp. and sold as part number FRZ-024-0.75K. Preferably, the motor is ⅓ HP (0.249 KW) and the inverter is a 1 HP (0.747 KW) unit. Alternatively, other means can be used to drive the endless member 30, such as an air motor, a DC motor, or a pneumatic cylinder.

To releasably grip and spread a sheet of laundry, a pair of clamps 36 and 38 are mounted to the endless member 30. In the illustrated embodiment, the left clamp 36 is fixedly attached to the front leg 32 and the right clamp 38 is fixedly attached to the rear leg 34 of the endless member 30. However, the clamps 36 and 38 can be coupled vice versa to the front leg 32 and rear leg 34. Thus, the inverter motor is adapted to move the endless member 30 in one direction to spread the clamps 36 and 38 apart and in an opposite direction to move the clamps toward each other. To guide the clamps 36 and 38 in a lateral direction, the clamps are movably connected to a horizontal guide bar 40 which is connected to the side walls 14 of frame 12.

The structure of the clamps 36 and 38 is substantially identical and will be described with like numerals. The clamps 36 and 38 each include a front vertical plate 42 and a rear vertical plate 43 having a pair of spaced apart rollers 44 extending therebetween. The rollers 44 are configured to roll along the guide bar 40 and support the clamps 36 and 38. To provide additional guidance, a low friction member 46 extends rearwardly from a top portion of the front plate 42 for slidable contact with a front side of the top cross-member. Similarly, a low friction member 47 extends forwardly from a top portion of the rear plate 43 for slidable contact with a rear side of the top cross-member 16. To grip opposing top corner portions of a sheet of laundry, a pair of horizontal grippers 48 extend laterally inward from a lower portion of each front plate 42 in a conventional manner. Preferably, the grippers 48 are actuated by a double acting pneumatic cylinder (not shown) to rapidly and securely clamp the corner portions of the sheet between the grippers 48. While the spreader mechanism 28 including endless member 30 and clamps 36 and 38 are illustrated for purposes of disclosure, it is contemplated that other spreading mechanisms having different constructions may be utilized within the scope of the invention.

Preferably, a lower spreader mechanism 50 is provided to assist in spreading the sheet. The lower spreader mechanism 50 is positioned below the feed conveyor 20 and includes two pairs of endless flexible belts 52 and 54 which are driven by an inverter motor (not shown). The inverter motor for the lower spreader mechanism 50 is preferably the same type as the inverter motor for the upper spreader mechanism 28. The pairs of belts 52 and 54 extend laterally outward from the centerline of the feed conveyor 20 and are positioned forwardly of the conveyor 20 to receive a sheet therebetween. When the spreading clamps 36 and 38 begin to move laterally apart, a lower portion of a sheet is placed between the lower belts 52 and 54 as will be described in more detail below. The sheet is then spread by the lower belts 52 and 54 at approximately the same rate as the spreading clamps 36 and 38. Preferably, the inverter motor for the belts 52 and 54 is adapted to move the belts in the opposite direction to return the sheet to the center position if a corner portion of the sheet is released during the spreading operation.

To transfer a sheet of laundry from a pickup station forwardly of the conveyor 20 to a spreading station adjacent the conveyor, a moving mechanism 56 is provided. The moving mechanism 56 includes a pneumatic cylinder 58 horizontally mounted to the frame 12 in alignment with the centerline of the feed conveyor 20. The cylinder 58 is positioned over the feed conveyor 20 and above a plane defined by the spreading clamp grippers 48. In addition, a horizontal bracket 60 is attached to the end of a piston rod 62 which extends outwardly from the cylinder 58. To releasably grip the corner portions of a sheet, a pair of transfer clamps 64 are attached to end portions of the bracket 60. The transfer clamps 64 each have a pair of grippers 66 which extend horizontally forward from the piston rod 62. Preferably, the grippers 66 are actuated by a double acting pneumatic cylinder (not shown) to rapidly and securely clamp the corner portions of the sheet between the grippers 66. As will be discussed in more detail below, the cylinder 58 is adapted to retract the transfer clamps 64 to a spreading position after the clamps have picked up the corner portions of a sheet. In the spreading position, the transfer clamp grippers 66 overlie the path of travel of the spreading clamp grippers 48. Thus, the spreading clamp grippers 48 move underneath the transfer clamp grippers 66 to pick up respective corner portions of the sheet. The spreading clamps 36 and 38 then move laterally apart to spread the sheet. Alternatively, the path of the spreading clamp grippers 48 can overlie the transfer clamp grippers 66 to pick up corner portions of the sheet extending above the transfer clamp grippers 66.

Other types of moving mechanisms can be provided for picking up the corner portions of the sheet and moving the sheet in a desired manner. For example, a pair of spreading clamps can be configured to transfer the sheet closer to the conveyor as well as spread the sheet. Such a mechanism is disclosed in U.S. patent application Ser. No. 08/214,684, filed Mar. 16, 1994, now U.S. Pat. No. 5,440,810 the specification of which is specifically incorporated herein by reference. In particular, the spreading clamps can include rotatable grippers which pick up the corner portions of the sheet at a pickup station, rotate to transfer the sheet closer to the feed conveyor 20, and move laterally apart to spread the sheet.

The aforementioned moving mechanism 56 and spreading mechanism 28 provide a simple, reliable way to pick up the corner portions of a sheet and spread the sheet accurately for subsequent placement of the sheet squarely on the feed conveyor 20. However, one disadvantage of past spreader-feeder machines has been the way in which the corner portions of the sheets are fed to such moving and/or spreading mechanisms. Typically, an operator has to locate one or more corner portions of the sheet and manually clamp the corner portions to the appropriate clamps. As will be described below, the transfer apparatus 67 of the present invention obviates this time consuming task by automatically locating the corner portions of the sheet for pickup by the transfer clamps 64.

The transfer apparatus 67 includes a pair of spaced apart delivery conveyor belts 68 which extend parallel to the belts 22 of the feed conveyor 20. The delivery belts 68 are endless, flexible members which wrap around a front roller 70 and a rear roller 72. The front roller 70 is positioned at a forward loading station and the rear roller 72 positioned at a pickup station closer to the feed conveyor 20. The front and rear rollers 70, 72 are interconnected by a horizontal support member 71 which is mounted on a pair of vertical beams 73. To provide a desired tension in the delivery belts 68, an adjustable spring 75 acts against a shaft of the front roller 70. Preferably, the front roller 70 is idle and the rear roller 72 is positively driven through a drive shaft 77 and an endless V-belt 79 by a ½ HP (0.374 KW) electric motor (not shown). The delivery belts 68 are driven in a direction such that the upper runs thereof move rearwardly to transport a sheet of laundry from the loading station to the pickup station. To position the sheet for engagement with the transfer clamps 64, the delivery belts 68 are centered with respect to the feed conveyor 20 and positioned above the horizontal plane of the transfer clamp gripper members 66. In addition, the overall width of the delivery belts 68 is less than the width of the sheet to allow side portions of the sheet to drape over the outermost edges of the belts 68. Preferably, the width of each delivery belt 68 is about three inches (7 cm), and the overall width of the deliver belts 68 is between 3–18 inches (7–46 cm). As will be discussed in more detail below, the side portions of the sheet are subsequently manipulated to locate the trailing corner portions for engagement with the transfer clamps 64. As a result, an operator can easily and quickly load a sheet by merely placing a center portion of the sheet on the delivery belts 68.

To facilitate placement of the sheet on the delivery belts 68, a curved spreader bar 81 extends forwardly beyond the front roller 70 of the delivery belts 68. The spreader bar 81 is preferably U-shaped to fan out the sheets so that a center portion is directed onto the delivery belts 68 and the side portions drape over the delivery belts 68 as the sheet progresses.

In order to grip the sheet and transfer it to the pickup station, a pair of spaced apart gripper conveyor belts 74 are disposed directly above the delivery conveyor belts 68. The gripper belts 74 are flexible, endless members which extend around idle front and rear rollers 76 and 78. A tensioning roller 83 is also positioned between the front and rear rollers 76, 78 to produce a desired tension in the lower run of the gripper belts 74. The rear roller 78 and tensioning roller 83 are rotatably mounted on a pair of support members 80 extending forwardly from the guide bar 40. Preferably, the front and rear rollers 76, 78 of the gripper belts 74 are positioned rearwardly of the corresponding front and rear rollers 70, 72 of the delivery belts 68. This allows an operator to place a generous portion of the sheet on a front portion of the delivery belts 68 to insure that the sheet will not drop to the floor due to the weight of the sheet.

To press the gripper belts 74 downwardly against the delivery belts 68 in a free-floating manner, a pair of spring biased pivot rods 85 interconnect the front and rear rollers 76 and 78. The rods 85 pivot about the shaft of the rear roller 78 which is rotatably attached to the support members 80. Thus, the gripper belts 74 cooperate with the delivery belts 68 to grip a center portion of a sheet of laundry and move the sheet by frictional engagement toward the feed conveyor 20. To prevent a sheet from being transported when a previous sheet has not yet reached a desired location, a push member (not shown) is provided. The push member acts against the pivot rods 85 to force the gripper belts 74 out of engagement with the delivery belts 68. When the gripper belts 74 are pivoted upwardly, a sheet which is placed on the front portion of the delivery belts 68 will not move because there is not enough friction to carry the sheet.

Figure 3:
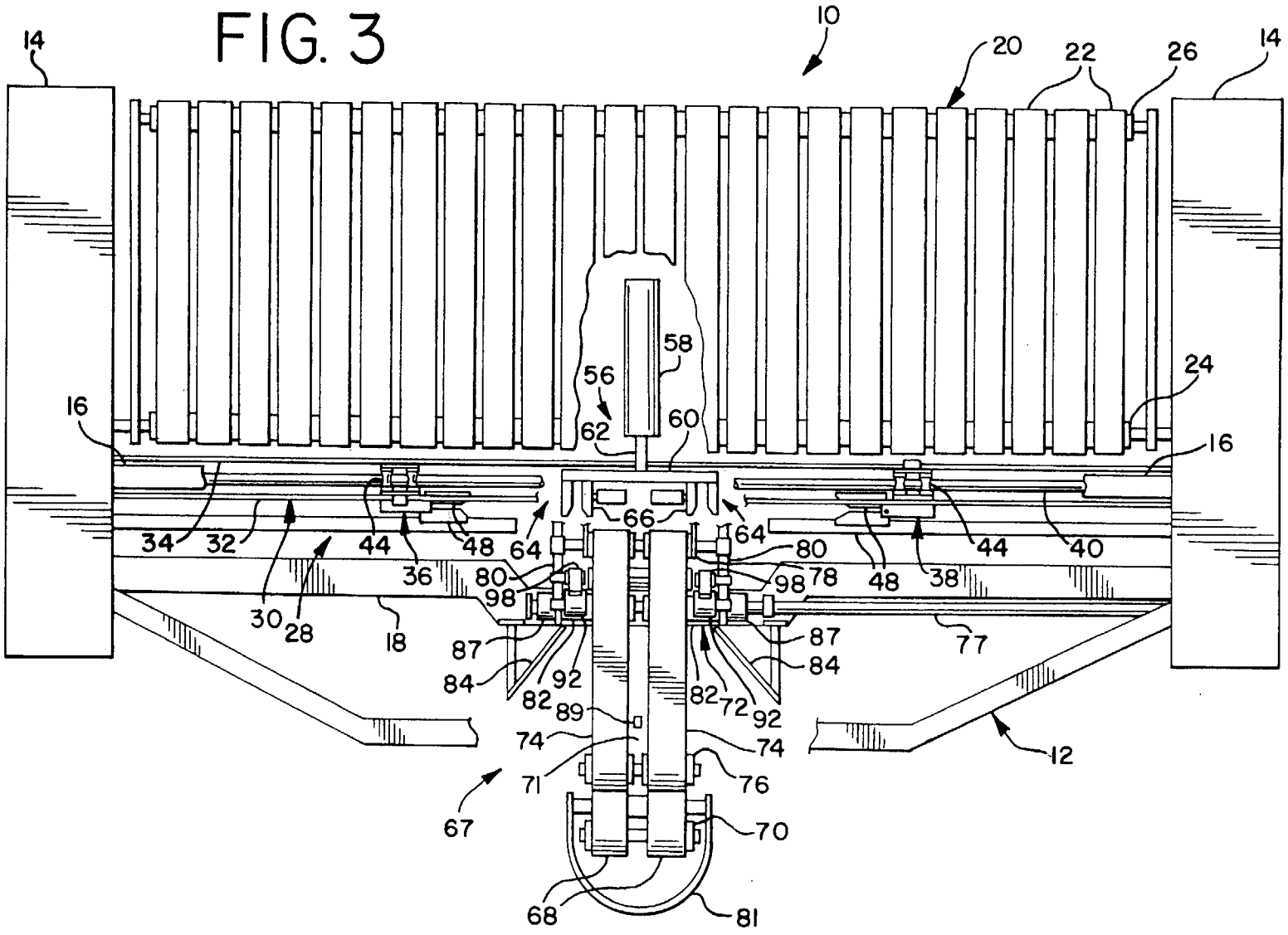
FIG. 3 is a top view of the invention shown with various components removed for clarity.
Figure 4:
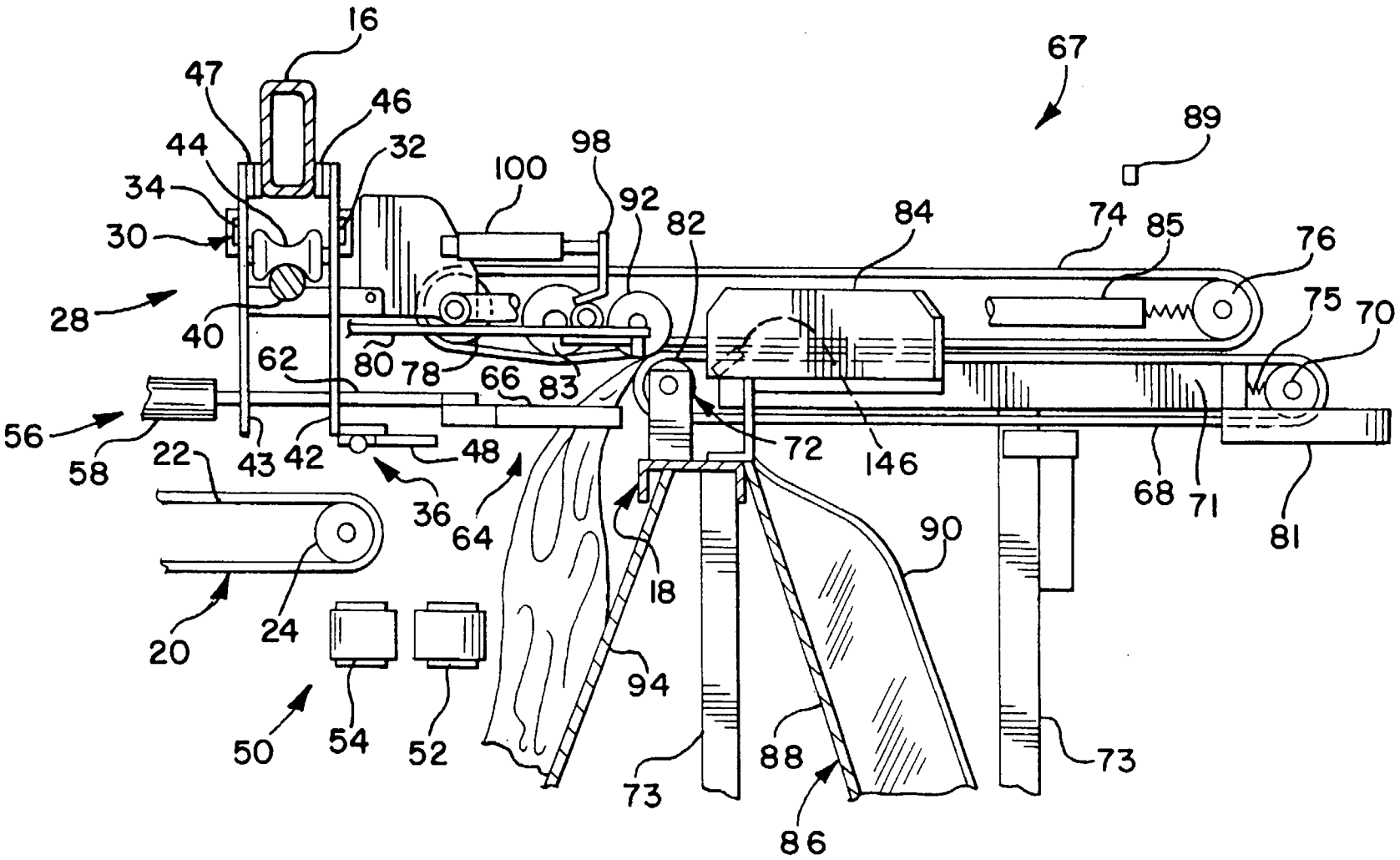
FIG. 4 is a side view of the invention showing various components in cross-section.
Figure 5:
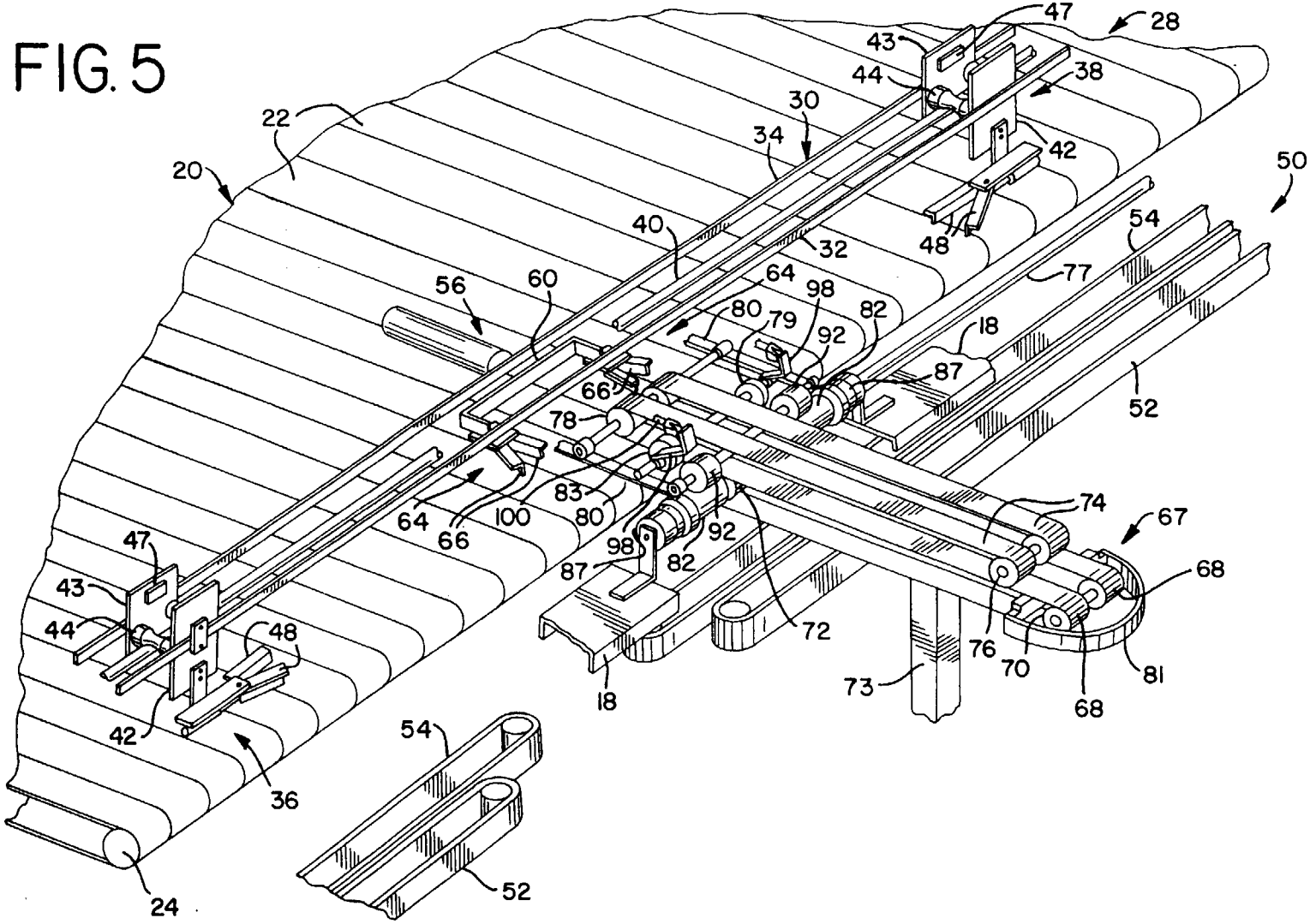
FIG. 5 is a partial perspective view of the invention showing a transfer mechanism, a moving mechanism, and upper and lower spreading mechanisms.

To actuate the push member, a photosensor 89 is disposed above the gripper belts 74 and rearwardly of the front roller 76 (FIGS. 3 and 4). Preferably, the photosensors described herein are made by Microswitch and sold as P/N FE7B-DB6-M. The photosensor 89 can be mounted on an upper portion of the frame 12 extending over the desired location (not shown). When a trailing edge of a previous sheet passes the photosensor 89, a signal is sent to actuate the push member which pivots the rods 85 and gripper belts 74 upward a short distance and out of engagement with the delivery belts 68. As noted above, this prevents a new sheet from being transported before the previous sheet has reached a desired location. When a material ready signal is received indicating that the previous sheet has been grabbed by the gripper members 66 and retracted to the spreading position, the push member is retracted to allow the gripper belts 74 to freely float against the delivery belts 68. The delivery belts 68 and gripper belts 74 then cooperate to move the new sheet toward the pickup station. In addition, the photosensor 89 prevents jamming of the sheet if a new sheet is placed on top of a previous sheet. In that event, the trailing edge of the previous sheet will not be detected by the photosensor 89, and the first sheet will fall to the floor because there is nothing to trigger the clamping of the first sheet as described below.

It is contemplated that other transfer mechanisms having different constructions can be utilized within the scope of the invention. For example, a single conveyor belt and gripper belt can be utilized, and the belts can angle upwardly from the loading station. Moreover, a movable clamp can be provided to grip a central portion of the sheet from an operator. The movable clamp could be adapted to drape the sheet over a stationary guide member until the trailing corner portions of the sheet are located for a moving mechanism.

As the sheet advances on the delivery belts 68, the draped side portions rise and pass over a pair of positioning members 82. Preferably, the positioning members 82 are configured as rollers disposed adjacent opposing ends of the rear roller 72. The positioning rollers 82 are positively driven by the drive shaft 77 and have respective clutch and brake units 87 operably engaged thereto. The side portions of the sheet are directed toward the positioning members 82 by a pair of substantially vertical guide plates 84 which converge inwardly toward terminal ends of the positioning members 82. In addition, a lower guide plate 86 is disposed underneath the delivery belts 68 to direct the side portions of the sheet toward the positioning members 82 (FIGS. 1 and 4). Preferably, the lower guide plate 86 is made of a transparent material such as Plexiglas®. The lower guide plate 86 includes a central portion 88 which faces the oncoming sheet. The central portion 88 angles upwardly and rearwardly from the floor toward a center section of the front cross-member 18 which supports the rear roller 72. The lower guide plate 86 also includes lateral portions 90 which angle forwardly and outwardly from the central portion 88 to catch and direct the side portions of the sheet.

Other positioning members can be used to locate the trailing corner portions of the sheet. For example, the positioning members can be configured as end portions of the rear roller 72 which extend beyond the outermost edges of the delivery belts 68. The positioning members could also be configured as fixed cylinders or curved plates to allow the side portions of the sheet to pass thereover. Moreover, other guide members can be provided to direct the side portions of the sheet toward the positioning members. For example, the positioning members could have end plates extending radially outward therefrom.

As the side portions of the sheet pass over the positioning members 82, they are held down by a pair of idle nip rollers 92. The nip rollers 92 are rotatably attached to the support members 80 and are passively driven by the positioning members 82. Preferably, the support members 80 are relatively thin to allow deflection which compensates for the variable thickness of the sheet as it passes between the nip rollers 92 and the positioning members 82. As the sheet progresses, the leading edge falls toward the floor until the entire sheet disengages the delivery belts 68 and only the trailing corner portions remain between the nip rollers 92 and the positioning members 82. It will be appreciated that a central portion of the trailing edge advances at a faster rate than the trailing corner portions of the sheet because the central portion is carried directly by the delivery belts 68. Preferably, a support plate 94 is disposed underneath the rear roller 72 to support the sheet as it falls from the delivery belts 68 (FIGS. 1 and 4). As with the guide plate 86, the support plate 94 is preferably made of a transparent material such as Plexiglas® to allow an operator to view the processing of the sheet.

Once the sheet has reached the pickup position and the trailing corner portions are located between the nip rollers 92 and the positioning members 82, the clutch and brake unit 87 disengages the positioning members 82 from the drive shaft 77 and stops rotation of the positioning members 82. At the same time, a pair of retractable shoes 98 are forced against respective ones of the nip rollers 92 by a pneumatic cylinder 100 (FIG. 4) to prevent rotation of the nip rollers 92. Thus, the trailing corner portions of the sheet are held in position between the positioning members 82 and nip rollers 92 for pickup by the transfer clamps 64. Preferably, the nip rollers 92 and the shoes 98 are rotatably attached to the pivotal support members 80 so that the nip rollers 92 are in free-floating engagement with the positioning members 82. To facilitate gripping of the trailing corner portions of the sheet, the positioning members 82 are preferably wrapped with a high-friction material such as polyurethane.

Other types of holding devices can be provided for holding the trailing corner portions of the sheet in the desired location. For example, the nip rollers 92 can be positively driven at the same speed as the positioning members 82. A second clutch and brake unit can also be provided to disengage the nip rollers 92 from their respective drive shafts and stop rotation thereof. Moreover, the transfer apparatus 67 as a whole can be mounted on a separate frame to allow retrofitting to existing spreader-feeder machines.

Figure 6:
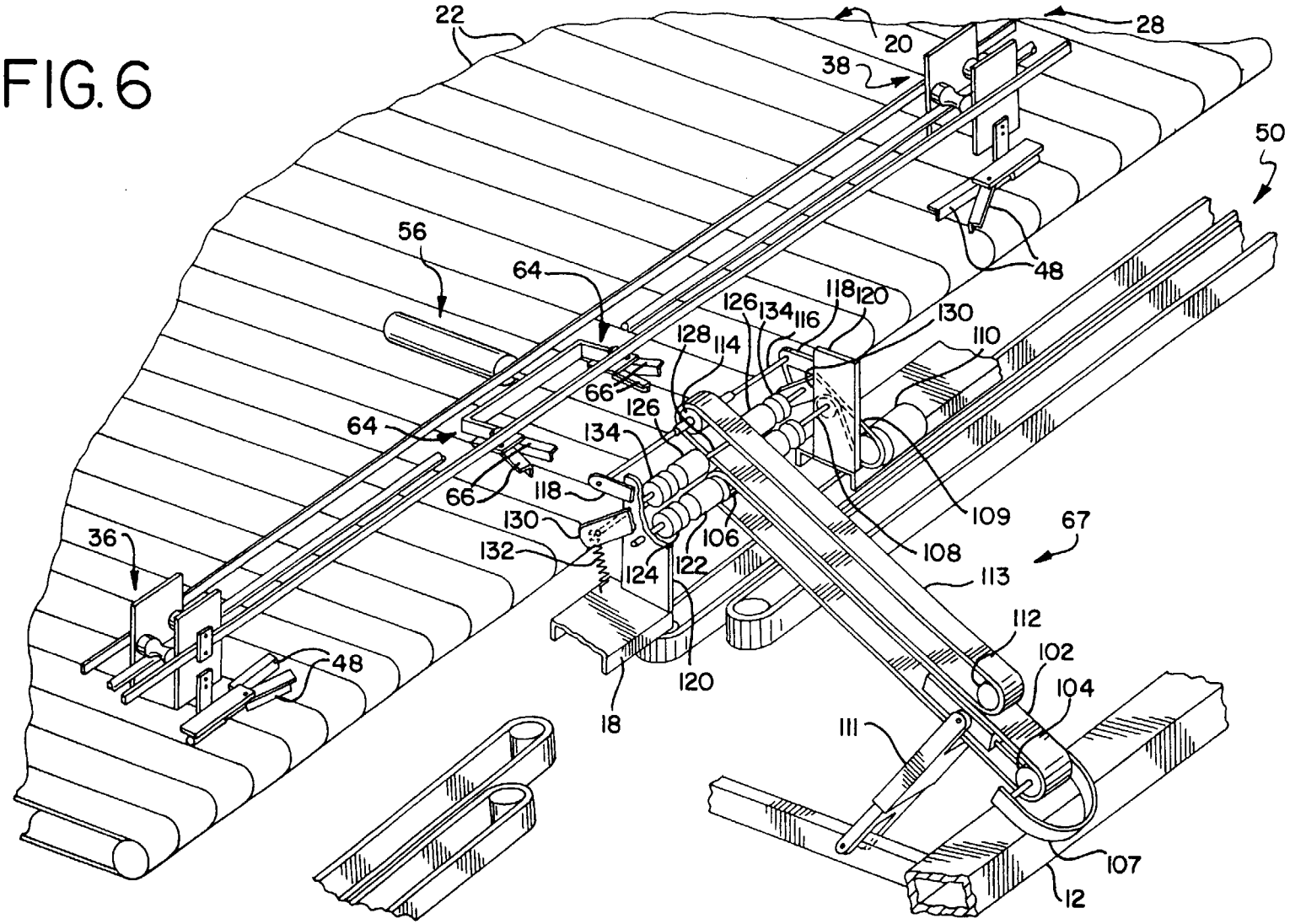
FIG. 6 is an alternative embodiment of the invention showing a transfer apparatus, a moving mechanism, and upper and lower spreading mechanisms.
Figure 7:
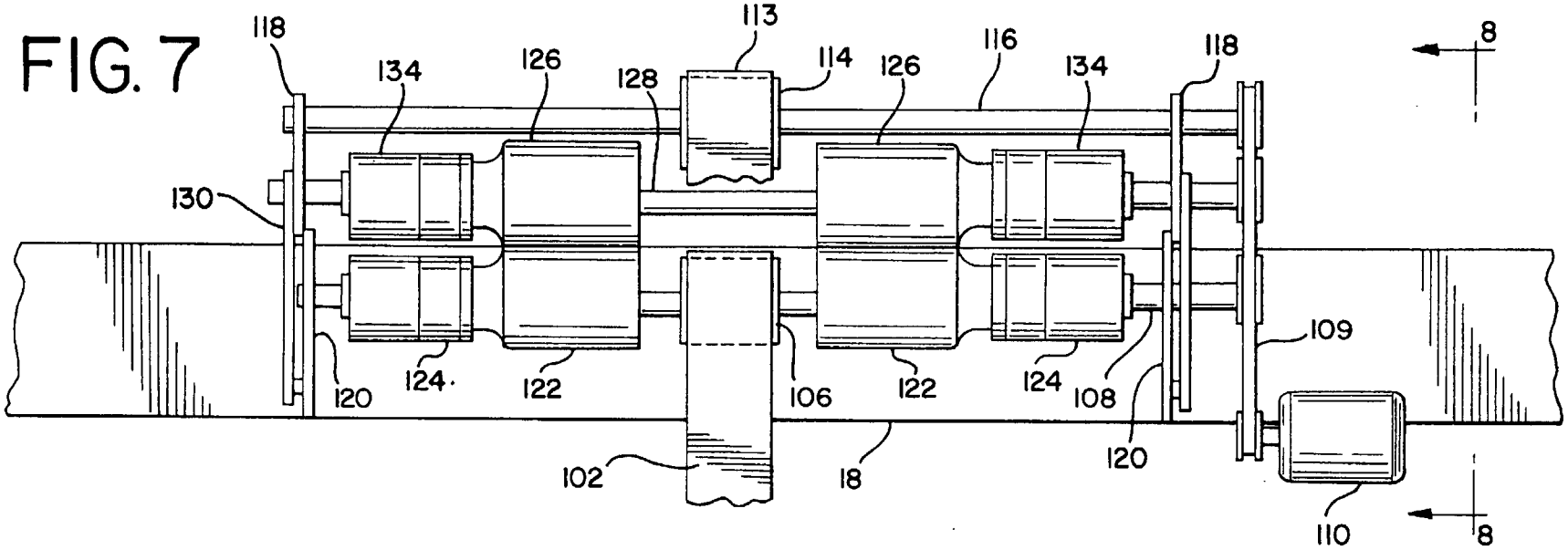
FIG. 7 is a partial front view of the transfer apparatus shown in FIG. 6.
Figure 8:
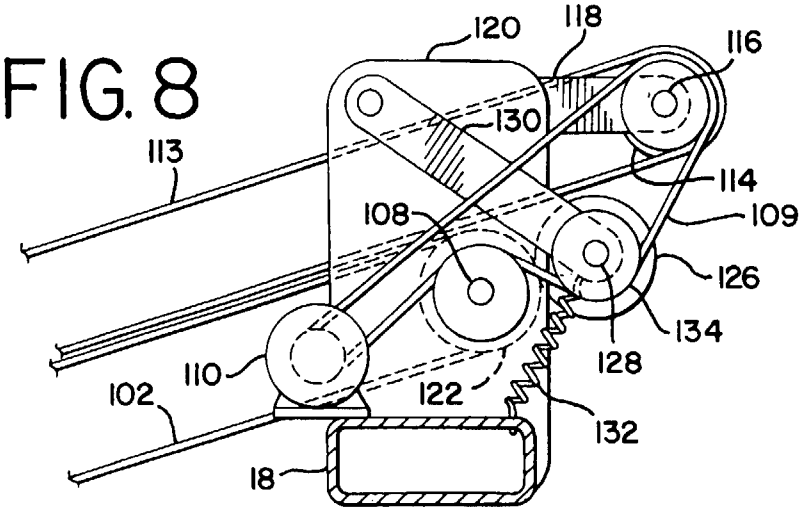
FIG. 8 is a partial side view of the transfer apparatus shown in FIGS. 6 and 7.

An alternative embodiment of the transfer apparatus 67 is illustrated in FIG. 6. Since the embodiment in FIG. 6 has portions similar to the previously described embodiment, similar parts are represented by the same, corresponding reference numerals. The transfer apparatus 67 includes a single delivery conveyor belt 102 which extends in the same general direction as the belts 22 of the feed conveyor 20. The delivery belt 102 is an endless, flexible member which wraps around a front roller 104 at the loading station and a rear roller 106 at the pickup station. The front roller 104 is positioned below the rear roller 106 so that the delivery belt 102 angles upwardly from the loading station to the pickup station. Preferably, the front roller 104 is idle and the rear roller 106 is mounted on a drive shaft 108 which is positively driven through an endless V-belt 109 by a ½ HP (0.374 KW) electric motor 110 with an inverter unit. As with the delivery belts 68 described above, the delivery belt 102 is driven in a direction such that the upper run thereof moves rearwardly to transport a sheet of laundry from the loading station to the pickup station. To position the sheet for engagement with the transfer clamps 64, the delivery belt 102 is centered with respect to the feed conveyor 20, and the rear roller 106 is positioned above the path of travel of the transfer clamp gripper members 66. In addition, the width of the delivery belt 102 is preferably about three inches (7 cm) wide, which is less than the width of typical laundry articles processed by spreader-feeder machines. Thus, the relatively narrow width of the delivery belt 102 allows side portions of the sheet to drape over the delivery belt 102 for subsequently locating the trailing corner portions of the sheet. A curved spreader bar 107 is also provided to fan out the sheets when initially placed on the delivery belt 102. Preferably, the spreader bar 107 is about seven inches (18 cm) wide and about 36–42 inches (91–107 cm) high. In addition, a telescoping support leg 111 interconnects the delivery belt 102 and the frame 12 to allow adjustment of the height and angle of the delivery belt.

To grip the sheet and transfer it toward the feed conveyor 20, a gripper conveyor belt 113 overlies the delivery conveyor belt 102. The gripper belt 113 is a flexible, endless member which extends around a front roller 112 and a rear roller 114. The front roller 112 is positioned below the rear roller 114 so that the gripper belt 113 angles upwardly at the same angle as the delivery belt 102. Preferably, the front and rear rollers 112, 114 of the gripper belt 113 are offset from the corresponding front and rear rollers 104, 106 of the delivery belt 102. The front roller 112 is idle and the rear roller 114 is mounted on a transverse shaft 116 which is rotatably connected to a pair of pivot arms 118. The pivot arms 118 are pivotally connected to a pair of support plates 120 which extend upwardly from the front cross-member 18 of the frame 12. In addition, the shaft 116 is positively driven in the opposite direction of the shaft 108 through the V-belt 109. Thus, the gripper belt 113 is driven at the same speed as the delivery belt 102 and cooperates therewith to grip a center portion of a sheet of laundry and move the sheet toward the feed conveyor 20. In addition, the V-belt 109 and pivot arms 118 act to hold the gripper belt 113 downwardly against the delivery belt 102. The combination of a relatively low front roller 104 at the loading station, the angle of the delivery belt 102, the offset orientation of the gripper belt 113 relative to the delivery belt 102, and the spreader bar 107 facilitates the ease and speed with which an operator can load a sheet of laundry onto the delivery belt 102.

As the sheet advances on the delivery belt 102, the draped side portions rise and pass over a pair of positioning rollers 122. The positioning rollers 122 are attached to the drive shaft 108 adjacent the ends of rear roller 106 of the delivery belt 102. In addition, each positioning roller 122 has an associated clutch and brake unit 124 operably attached thereto. As the side portions of the sheet pass over the positioning rollers 122, they are held down by a pair of idle nip rollers 126. The nip rollers 126 are mounted on a transverse rod 128 and are actively driven through the V-belt 109 by the motor 110. The rod 128 is rotatably attached to a pair of arms 130 which are pivotally attached to the support plates 120. To force the nip rollers 126 against the respective positioning rollers 122, a spring 132 is attached to pivot arm 130 and the front cross-member 18. In addition, each nip roller 126 has an associated clutch and brake unit 134 operably attached thereto. When the trailing corner portions of the sheet are between the positioning rollers 122 and the nip rollers 126, the clutch and brake units 124 and 134 disengage and stop rotation of their respective rollers 122 and 126. The trailing corner portions of the sheet are therefore held between the positioning rollers 122 and the nip rollers 126 until the transfer clamps 64 pickup the corner portions.

It is contemplated that multiple transfer mechanisms 67 can be used to feed sheets to a plurality of corresponding spreading stations. For example, a pair of transfer mechanisms 67 could be used to transfer sheets of laundry to a pair of moving mechanisms 56 and two sets of corresponding spreading clamps 36 and 38.

Figure 9:
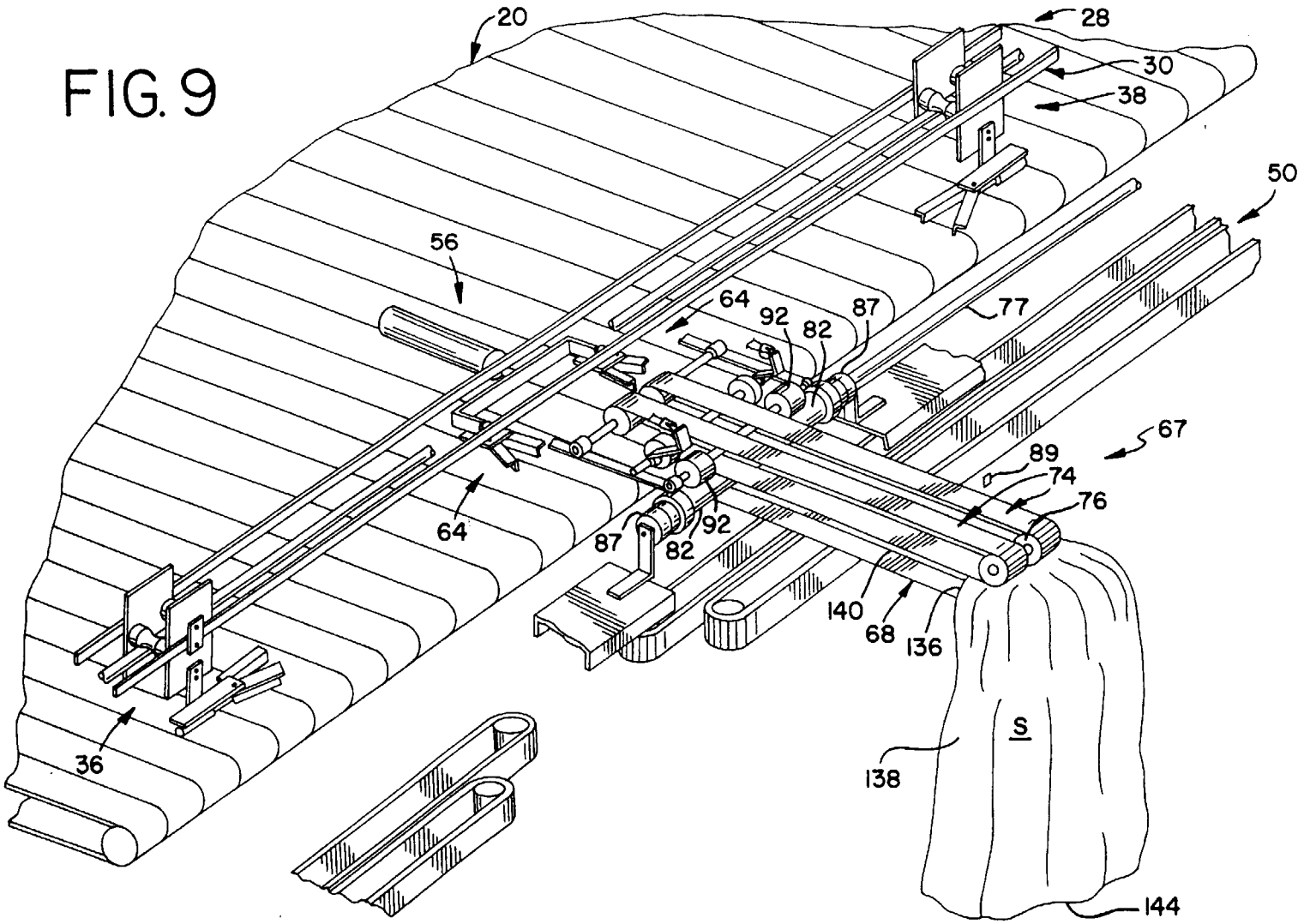
FIG. 9 is a partial perspective view of the invention showing initial placement of a leading edge portion of a sheet of laundry on a conveyor belt at a loading station.

The operation of the present invention will now be described with particular reference to FIGS. 9–13. An operator (not shown) is positioned at the loading station in front of the spreader bar 81. The operator grabs a leading edge 136 of a sheet S and places a central portion thereof between the gripper belts 74 and the delivery belts 68. As shown in FIG. 9, the sheet S is placed on the delivery belts 68 such that side portions 138 of the sheet drape over outermost edges 140 of the belts 68. If the trailing edge of a previous sheet has passed the photosensor 89 but the material ready signal has not been received, the sheet S remains on the front portion of the delivery conveyors 68 until the gripper belts 74 are lowered. Once the previous sheet reaches a desired location, the material ready signal actuates the push member (not shown) to lower the gripper belts 74 into free-floating engagement with the delivery belts 68. The delivery belts 68 and the gripper belts 74 then cooperate to grip the sheet S and carry it rearwardly toward the feed conveyor 20. As the sheet S advances rearwardly, the spreader bar 81 fans out the sheet S so that the side portions 138 continue to drape over the delivery belts 68. In addition, the side portions 138 of the sheet S are directed toward the positioning members 82 by the guide plates 84 and 86 (FIGS. 1–4).

Figure 10:
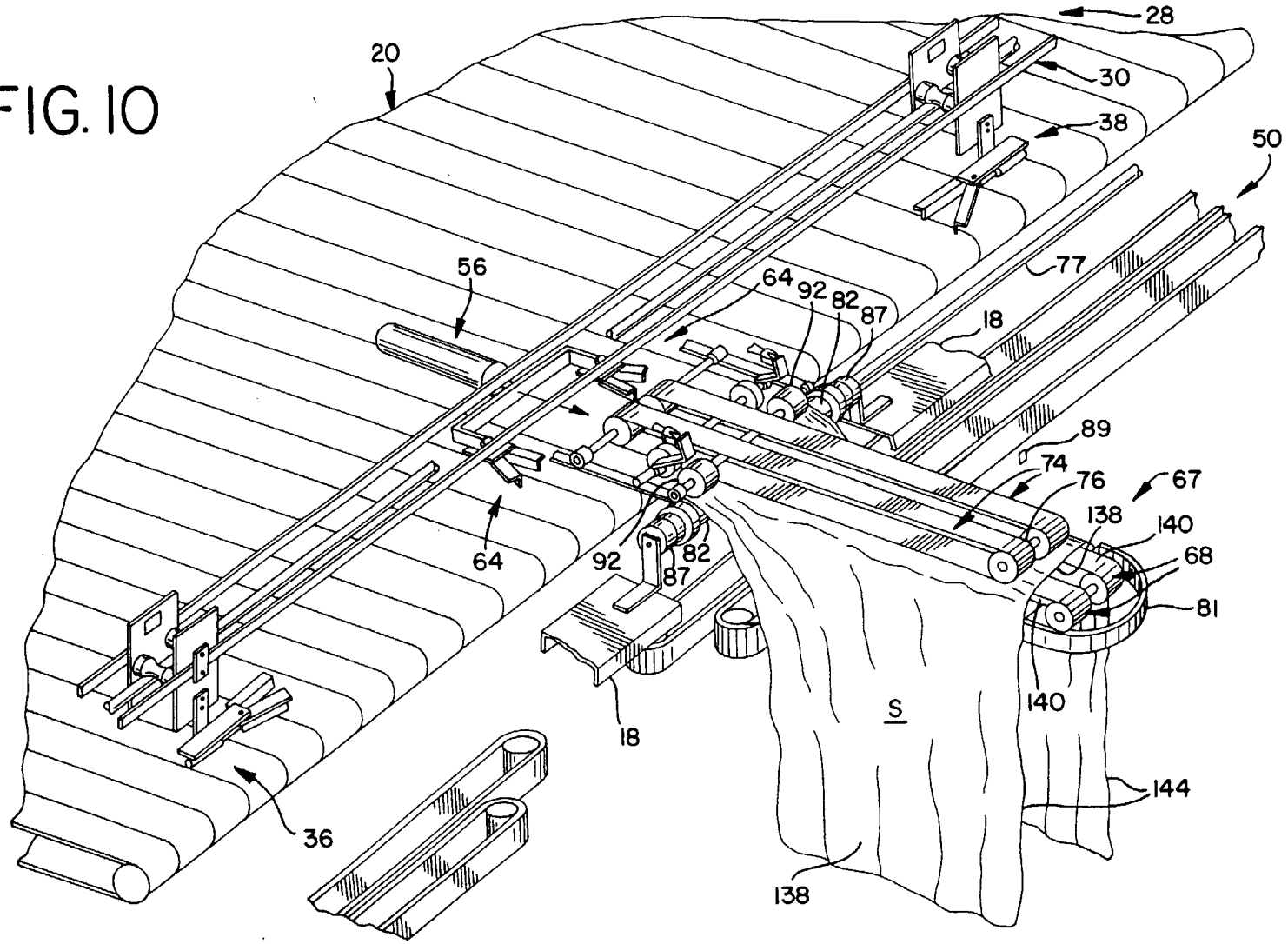
FIG. 10 is a partial perspective view of the invention showing the sheet being transferred by the conveyor belt from the loading station to a pickup station.

As the sheet S progresses further, the side portions 138 rise and pass between the positioning members 82 and the nip rollers 92 as shown in FIG. 10. To allow sufficient time for processing the sheet S, a photosensor 89 is disposed above the gripper belts 74 and rearwardly of the front roller 76. Preferably, the photosensors described herein are made by Microswitch and sold as P/N FE7B-DB6-M. The photosensor 89 can be mounted on an upper portion of the frame 12 extending over the desired location (not shown). When a trailing edge 144 of the sheet S passes the photosensor 89, a signal is sent to actuate the push member (not shown) which pivots the rods 85 and gripper belts 74 upward a short distance and out of engagement with the delivery belts 68. This prevents a new sheet from being transported before the sheet S has reached a desired location because the delivery belts 68 will not carry the new sheet without the aid of the gripper belts 74. If a new sheet is placed on top of sheet S so that the trailing edge 144 of sheet S is not detected by the photosensor 89, the sheet S will fall to the floor because there is nothing to trigger the clamping action of the positioning members 82 and nip rollers 92 as described below.

Figure 11:
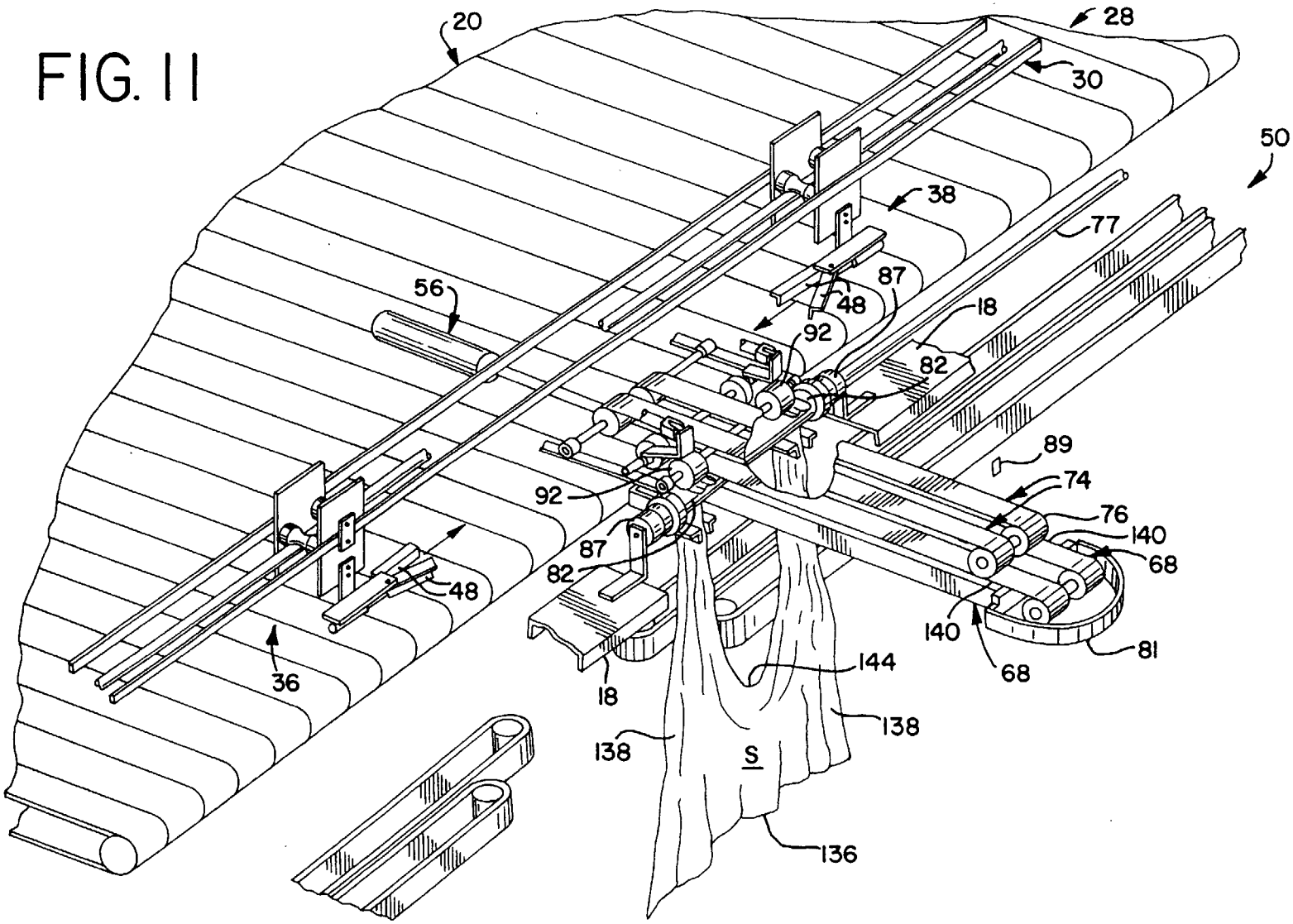
FIG. 11 is a partial perspective view of the invention showing the sheet at the pickup station where a pair of holding rollers are holding trailing corner portions of the sheet and a pair of transfer clamps are engaging the trailing corner portions.

As shown in FIG. 11, the leading edge 136 then falls toward the floor until the entire sheet S disengages the delivery belts 68 and only the trailing corner portions remain between the positioning members 82 and the nip rollers 92. To detect when the sheet S is properly positioned for pickup by the transfer clamps 64, a pair of photosensors 146 (FIGS. 2 and 4) are disposed adjacent a lower front portion of the positioning members 82 (see FIG. 4). Preferably, the photosensors 146 are mounted to the guide plates 84 and angle downwardly toward the lower front portion of the positioning members 82. When the trailing corner portions leave engagement with the respective photosensors 146, signals are sent to actuate the associated clutch and brake units 87. The clutch and brake units 87 then disengage their respective positioning members 82 from the drive shaft 77 to stop rotation of the positioning members 82. At the same time, the respective pneumatic cylinders 100 are actuated to force the shoes 98 against the nip rollers 92. The shoes 98 stop the rotation of the nip rollers 92 to thereby clamp the trailing corner portions 138 of the sheet S against the nip rollers 92. Thus, the trailing corner portions 138 of the sheet S are held in position for pickup by the transfer clamps 64. If the sheet S is laid crookedly on the delivery belts 68 or completely off-center, the clutch and brake units 87 and the cylinders 100 are independently actuated to clamp the corner portions. Thus, one corner portion can be clamped and held at the pickup station until the other corner portion catches up and is subsequently clamped.

When both trailing corner portions of the sheet S disengage the photosensors 146 and are properly held at the pickup station, a signal is sent to actuate the pneumatic cylinder 58. As a result, the transfer clamps 64 are moved forwardly from the retracted spreading position to the pickup station. After a time delay to allow the transfer clamp grippers 66 to receive the trailing corner portions of the sheet therebetween, the grippers 66 are closed to clamp the corner portions. At the same time, the spreading mechanism 28 is actuated to begin moving the spreading clamps 36 and 38 toward each other.

Figure 12:
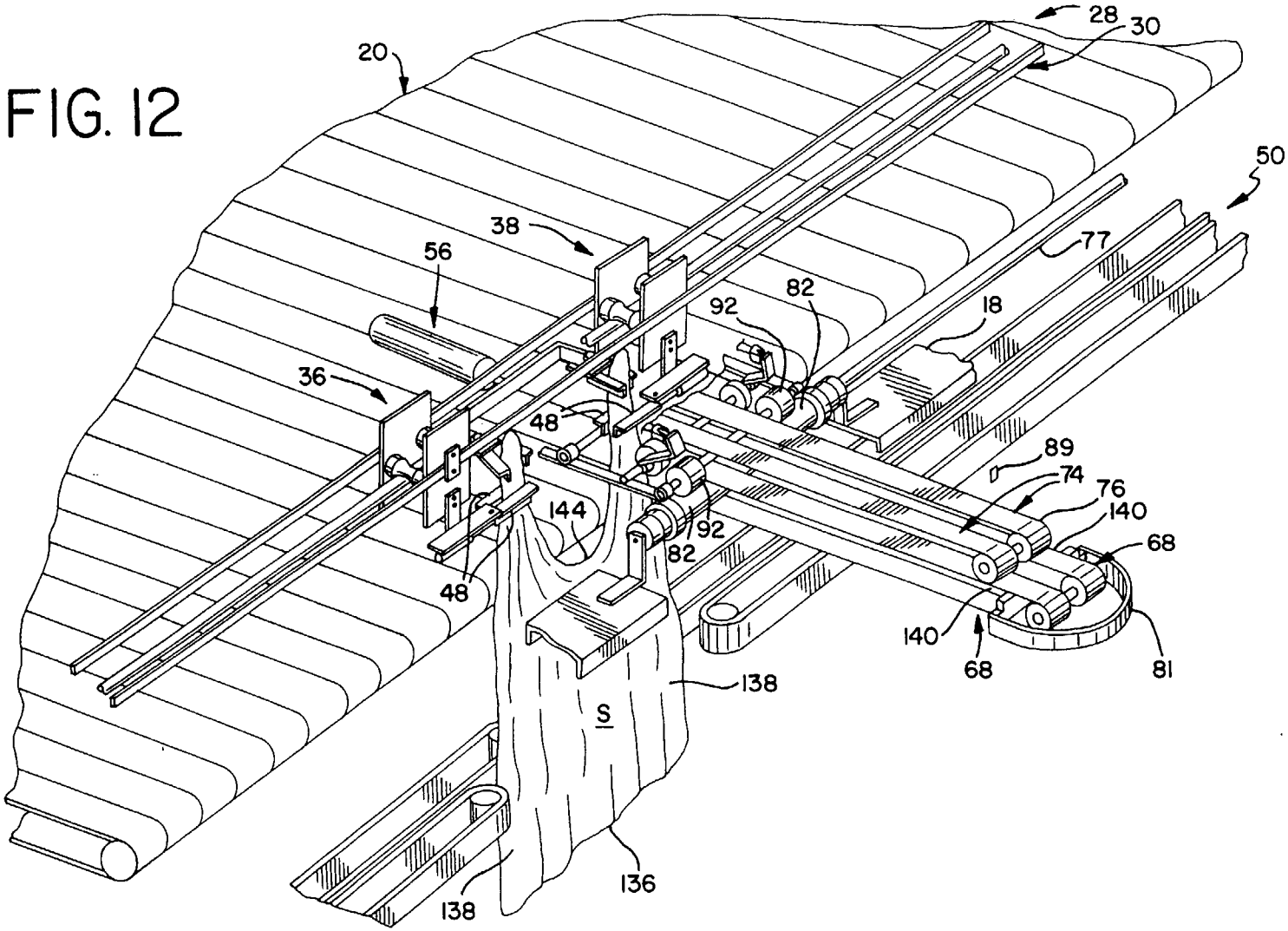
FIG. 12 is a partial perspective view of the invention showing the transfer clamps retracted to a spreading position where a pair of spreading clamps are engaging the trailing corner portions of the sheet.
Figure 13:
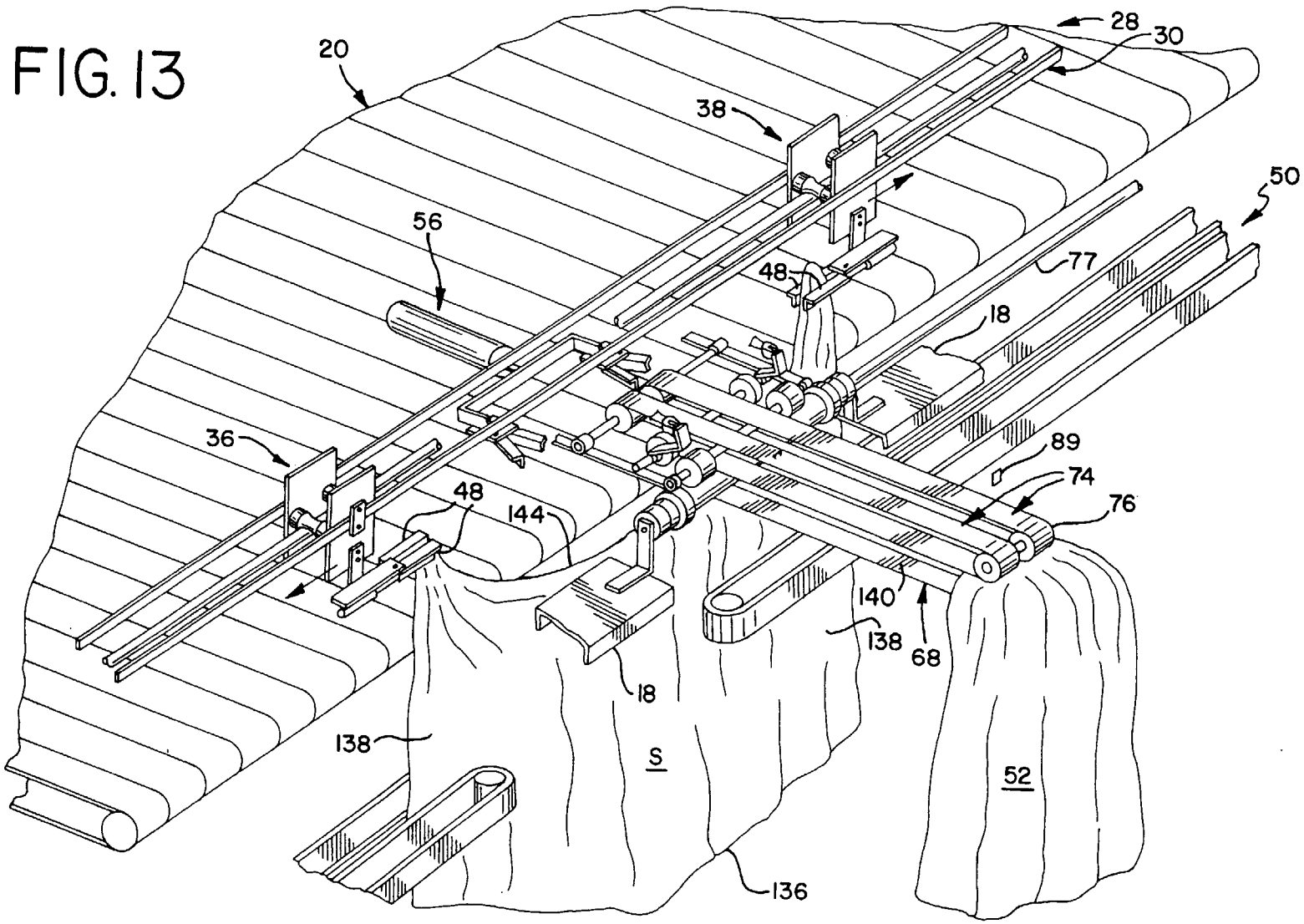
FIG. 13 is a partial perspective view of the invention showing the spreading clamps spreading the sheet for subsequent placement on a feed conveyor.

As shown in FIG. 12, the transfer clamps 64 are then retracted to the spreading position for pickup by the spreading clamps 36 and 38. The spreading clamps 36 and 38 reach the spreading position shortly after the transfer clamps 64, where the spreading clamp grippers 48 receive the corner portions of the sheet S underneath the transfer clamp grippers 66. Preferably, proximity sensors (not shown) are positioned to detect when the respective spreading clamps 36 and 38 reach the spreading position in FIG. 12. The proximity sensors are preferably made by Electromatic and sold as P/N ACF10NP0. When the spreading clamps 36 and 38 reach the proximity sensors, the spreading clamp grippers 48 are closed to clamp the corner portions of the sheet S. The transfer grippers 48 are then opened to release the sheet S, and the clamps 36 and 38 are moved apart to spread the sheet S as shown in FIG. 13. When the sheet S is spread by the clamps 36 and 38, a lower portion of the sheet is gripped by the lower spreader belts 52 and 54 to assist the spreading operation. FIG. 13 also shows a second sheet S2 being placed on the delivery belts 68.

To feed a sheet onto the conveyor 28 after it is fully spread, a plurality of elongated air tubes (not shown) extend horizontally adjacent a front edge portion of the feed conveyor 20. The air tubes have a plurality of openings spaced apart along their lengths in a rear side thereof for directing jets of air rearwardly across the top of the conveyor 20. It will be appreciated that the operation of the transfer mechanism 67 causes the leading edge 136 of the sheet to become the trailing edge, and vice versa, for laydown onto the feed conveyor 20. Thus, the edge 144 of the sheet S rises above the air tubes when the clamps 36 and 38 are spread apart. When the sheet S is in a fully spread position, the air tubes are located forwardly of the sheet so that when the clamps 36 and 38 release the sheet, pressurized air forces the sheet rearwardly onto the feed conveyor 20.

To control the continuous spreading of sheets and laydown onto the feed conveyor 20, a pair of trailing edge photosensors (not shown) are located below the feed conveyor 20. After a sheet is blown onto the feed conveyor 20, the trailing edge move upwardly as the sheet is carried by the conveyor 20. Thus, if the trailing edge of a previous sheet (not shown) has not moved upwardly past the trailing edge sensors by the time the spreader clamps 36 and 38 have gripped the corner portions of the sheet S, the inverter motor will stop the endless member 30 to delay the spreading of the clamps. As soon as the trailing edge has been detected, the inverter motor is actuated to resume the spreading operation.

This insures that the first sheet has advanced far enough on the feed conveyor 20 to avoid any overlap of the sheets.

The operation of the embodiment shown in FIGS. 6–9 is essentially the same as the above described embodiment. Rather than using the passively rotatable hold-down roller 92 and the pneumatically actuated shoe 98, the clutch and brake units 134 are independently actuated to stop rotation of the respective nip rollers 126. In addition, the clutch and brake units 124 are independently actuated to stop rotation of the respective positioning rollers 122. Thus, when the trailing corner portions 136 of the sheet S disengage the photosensors 146, a signal is sent to the clutch and brake units 126 and 134 to disengage their respective drive shafts 108 and 128. The rotation of rollers 122 and 126 is then halted to thereby clamp the trailing corner portions 138 of the sheet therebetween.

Thus, a simple, compact loading and transferring apparatus is provided which increases the speed at which a single operator can load sheets for accurate placement onto a feed conveyor.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

I claim:

1. An apparatus for transferring a flatwork article having a leading edge and a trailing edge opposite the leading edge, the apparatus comprising:

a transfer mechanism adapted to grip a leading edge portion of the article between leading corner portions thereof and move the article from a loading station to a pickup station;

a positioning device adapted to guide a trailing edge portion of the article into position for engagement with a moving mechanism at the pickup station;

said moving mechanism adapted to pick up the trailing edge portion of the article at the pickup station and move the article away from said pickup station.

2. The apparatus of claim 1 wherein the positioning device is configured to guide a trailing corner portion of the trailing edge of the article into position for engagement with the moving mechanism at the pickup station.

3. The apparatus of claim 1 wherein the transfer mechanism comprises a carrying member having a width less than the width of the article to allow side portions of the article to drape over the carrying member.

4. The apparatus of claim 1 wherein the moving mechanism comprises a first mechanism adapted to engage the article at the pickup station and move the article toward a feed conveyor to a spreading position, and a second mechanism adapted to pick up the article from the first mechanism and spread the article for placement onto the feed conveyor.

5. An apparatus for transferring a flatwork article having a leading edge portion defined between first and second leading corner portions, and a trailing edge portion opposite the leading edge portion and defined between first and second trailing corner portions, the apparatus comprising:

a transfer mechanism adapted to grip the leading edge portion of the article between leading corner portions thereof and move the article from a loading station to a pickup station;

a positioning device adapted to locate said first and second trailing corner portions at the pickup station for pickup by a moving mechanism;

said moving mechanism adapted to pick up the first and second trailing corner portions of the article at the pickup station and move the article away from said pickup station.

6. The apparatus of claim 5 wherein the positioning device comprises a pair of spaced apart, stationary positioning rollers at the pickup station and the transfer mechanism is adapted to carry the article past the rollers such that the trailing corner portions engage the rollers at the pickup station.

7. The apparatus of claim 6 further comprising a pair of positioning rollers and wherein the transfer mechanism is adapted to carry side portions of the article over the positioning rollers, and wherein the positioning rollers are actively related to assist in moving the side portions of the article thereover.

8. The apparatus of claim 7 wherein the positioning rollers are adapted to stop independently when the respective trailing corner portions reach the positioning rollers.

9. The apparatus of claim 6 further comprising a holding device adapted to hold the trailing corner portions of the article against the positioning rollers when the trailing corner portions are located between positioning rollers and the holding device.

10. The apparatus of claim 9 wherein the positioning rollers are actively rotated and the holding device comprises spaced apart rollers cooperating with respective ones of the positioning rollers, and wherein one set of said cooperating positioning rollers and holding rollers is adapted to stop rotating independently of another set of said cooperating positioning rollers and holding rollers.

11. The apparatus of claim 5 further comprising spaced apart guide plates positioned forwardly of the positioning device and converging toward the positioning device to direct the sheet toward the positioning device.

12. The apparatus of claim 5 wherein the moving mechanism comprises a pair of spreading clamps adapted to releasably grip the respective first and second trailing corner portions of the article at the pickup station.

13. An apparatus for transferring a flatwork article having a leading edge and a trailing edge opposite the leading edge, the apparatus comprising:

a transfer mechanism adapted to grip a leading edge portion of the article between leading corner portions thereof and move the article from a loading station to a pickup station;

a positioning device adapted to locate a trailing edge portion of the article at the pickup station for engagement with a moving mechanism;

said moving mechanism adapted to pick up the trailing edge portion of the article at the pickup station and move the article away from said pickup station; and a holding device adapted to hold the trailing edge portion of the article at the pickup station for engagement with the moving mechanism.

14. An apparatus for transferring a flatwork article, comprising:

a transfer mechanism adapted to grid a leading edge portion of the article between leading corner portions thereof and move the article from a loading station to a pickup station, said transfer mechanism comprising a carrying member having a width less than the width of the article to allow side portions of the article to drape over the carrying member, said carrying member comprising a conveyor belt extending between the loading station and the pickup station, said conveyor belt adapted to grip the article by frictional engagement when the article is placed thereon and move the article from the loading station to the pickup station;

a positioning device adapted to locate a trailing edge portion of the article at the pickup station for engagement with a moving mechanism; and said moving mechanism adapted to pick up the trailing edge portion of the article at the pickup station and move the article away from said pickup station.

15. An apparatus for transferring a flatwork article having a leading edge and a trailing edge opposite the leading edge, the apparatus comprising:

a transfer mechanism adapted to grip a leading edge portion of the article between leading corner portions thereof and move the article from a loading station to a pickup station;

a positioning device adapted to locate a trailing edge portion of the article at the pickup station for engagement with a moving mechanism;

said moving mechanism adapted to pick up the trailing edge portion of the article at the pickup station and spread the article for placement onto a feed conveyor.

16. An apparatus for transferring a flatwork article, comprising:

a transfer mechanism adapted to grip a leading edge portion of the article between leading corner portions thereof and move the article from a loading station to a pickup station;

a positioning device adapted to locate a trailing edge portion of the article at the pickup station for engagement with a moving mechanism;

the moving mechanism comprising a first mechanism adapted to engage the article at the pickup station and move the article toward a feed conveyor to a spreading position, and a second mechanism adapted to pick up the article from the first mechanism and spread the article for placement onto the feed conveyor, the first mechanism comprising a first pair of clamps configured to releasably grip trailing corner portions of the article and the second mechanism comprising a second pair of clamps configured to releasably grip the trailing corner portions from the first pair of clamps.

17. An apparatus for transferring a sheet of laundry having a leading edge and a trailing edge opposite the leading edge from a loading station to a pickup station where the sheet is engageable by a moving mechanism for subsequent placement on a feed conveyor, the apparatus comprising:

a transfer mechanism including a carrying member adapted for placement of the sheet thereon and movement of said sheet from the loading station to the pickup station, said carrying member having a width less than the width of the sheet to allow side portions of the sheet to drape downwardly from the carrying member; and a positioning device configured to position a corner portion of the trailing edge of the sheet at the pickup station for engagement with the moving mechanism.

18. The apparatus of claim 17 wherein the carrying member comprises a first conveyor belt extending between the loading station and the pickup station, said conveyor belt adapted to grip the article by frictional engagement when the article is placed thereon and move the article from the loading station to the pickup station.

19. The apparatus of claim 18 further comprising a second conveyor belt positioned above the first conveyor belt for cooperatively gripping and moving of the sheet between said first and second conveyor belts.

20. The apparatus of claim 17 wherein the positioning device is located adjacent side edges of the carrying member at a rear end thereof such that the draped side portions of the sheet rise and pass over said positioning device to thereby locate trailing corner portions of the sheet for pickup by the moving mechanism.

21. The apparatus of claim 20 wherein the positioning device comprises a pair of spaced apart, stationary positioning rollers which are actively rotated to assist in moving the side portions of the sheet thereover.

22. The apparatus of claim 21 wherein the positioning rollers are adapted to stop independently when the respective trailing corner portions reach the positioning rollers.

23. The apparatus of claim 22 further comprising a pair of clutch and brake units operably engaging respective ones of said positioning rollers, said clutch and brake units adapted to independently stop rotation of their associated positioning rollers when the respective trailing corner portions reach the positioning members.

24. The apparatus of claim 21 further comprising a pair of holding rollers passively driven by respective ones of the positioning rollers, each holding roller adapted to stop independently when the respective trailing corner portions of the sheet are located between said holding roller and positioning roller.

25. The apparatus of claim 21 further comprising a pair of actively driven holding rollers cooperating with respective ones of said positioning rollers, and a pair of clutch and brake units operably engaging respective ones of said holding rollers, said clutch and brake units adapted to independently stop rotation of their associated holding rollers when the respective trailing corner portions reach the holding rollers.

26. The apparatus of claim 17 further comprising a holding device adapted to releasably hold the trailing corner portion of the sheet against the positioning device.

27. An apparatus for transferring a sheet of laundry from a loading station to a pickup station where the sheet is engageable by a moving mechanism for subsequent placement on a feed conveyor, the apparatus comprising:

a conveyor belt extending between the loading station and the pickup station, said conveyor belt adapted to move the sheet from the loading station to the pickup station, the width of the conveyor belt being less than the width of the sheet to allow side portions of the sheet to hang downwardly from the conveyor belt;

a pair of positioning members located adjacent opposite sides of the conveyor belt at a rear end thereof such that the overhanging side portions of the sheet rise and pass over said positioning members; and a pair of holding devices adapted to hold trailing corner portions of the sheet against respective ones of said positioning members when the sheet reaches the pickup station to hold said trailing corner portions for engagement with the moving mechanism.

28. The apparatus of claim 27 further comprising a pair of substantially vertical guide members positioned adjacent the positioning members, said guide members converging inwardly toward the positioning members to direct the sheet toward the positioning members.

29. The apparatus of claim 27 wherein the positioning members comprise actively rotated rollers adapted to stop independently when the respective trailing corner portions reach the positioning rollers.

30. The apparatus of claim 19 further comprising a pair of clutch and brake units operably engaging respective ones of said positioning rollers, said clutch and brake units adapted to independently stop rotation of their associated positioning rollers when the respective trailing corner portions reach the positioning rollers.

31. The apparatus of claim 29 wherein the holding devices comprise a pair of holding rollers operably engaging respective ones of said positioning rollers, said holding devices adapted to independently stop when the respective trailing corner portions of the sheet are located between the holding rollers and the positioning rollers.

32. The apparatus of claim 31 further comprising a pair of clutch and brake units operably engaging respective ones of said holding rollers, said clutch and brake units adapted to independently stop rotation of their associated holding rollers when the respective trailing corner portions reach the holding rollers.

33. A method of transferring a sheet of laundry having a leading edge and a trailing edge opposite the leading edge, said trailing edge having trailing corner portions, from a loading station to a pickup station where the sheet is engageable by a moving mechanism, the method comprising:

placing a central leading edge portion of the sheet on a transfer mechanism at the loading station;

moving the sheet from the loading station to the pickup station;

directing the trailing corner portions of the sheet into position for engagement with the moving mechanism at the pickup station;

stopping movement of the sheet at the pickup station; and holding the trailing corner portions of the sheet at the pickup station to position the sheet for engagement with the moving mechanism.

34. An apparatus for transferring a flatwork article having a leading edge portion defined between first and second leading corner portions, and a trailing edge portion opposite the leading edge portion and defined between first and second trailing corner portions, the apparatus comprising:

a transfer mechanism adapted to grip a central portion of the leading edge portion of the article and move the article from a loading station to a pickup station;

a positioning device adapted to locate said first and second trailing corner portions of the article at the pickup station; and a holding device adapted to hold said first and second trailing corner portions of the article at the pickup station for engagement with a moving mechanism, said moving mechanism adapted to engage said first and second trailing corner portions of the article at the pickup station and move the article away from said pickup station.

35. A method for finding two corners on a trailing edge of an article of laundry, wherein said trailing edge is opposite a leading edge of the article, said method comprising the steps of:

providing a central portion of the leading edge of the article to a moving mechanism;

advancing said central portion toward a pickup station while passing side portions of the article over sensing devices located in front of a pair of holding devices;

moving said central portion more quickly than said side portions;

dropping said central portion from said moving mechanism at the pickup station;

locating two corners on a trailing edge of the article by sensing the absence of the side portions of the article at the sensing devices; and activating each of said pair of holding devices to hold each of the two corners on a trailing edge of the article.

36. An apparatus for locating first and second corners of a trailing edge of a flatwork article, said article having a leading edge opposite the trailing edge and side edges adjacent the leading edge, the apparatus comprising:

a transfer mechanism adapted to grip a central portion of the leading edge of the article and move the article from a loading station to a pickup station;

a pair of positioning devices, one positioning device located on each side of the transfer mechanism at the pickup station;

a pair of sensing devices, one sensing device located in front of each positioning device;

said transfer mechanism adapted to carry side portions of the article over said positioning devices and sensing devices;

said sensing devices adapted to sense the passage of the side portions of the article and to actuate each of a pair of holding devices upon the arrival of the first and second corners;

said pair of holding devices located at the pickup station and adapted to hold the first and second corners of the trailing edge of the article.

* * * * *

UNITED STATES PATENT AND TRADEMARK OFFICE

CERTIFICATE OF CORRECTION

PATENT NO. : 5,515,627

DATED : May 14, 1996

INVENTOR(S) : Stanley G. McCabe

It is certified that error appears in the above-indentified patent and that said Letters Patent is hereby corrected as shown below:

On the Title Page

In line 2 under "FOREIGN PATENT DOCUMENTS", delete "0554205A1" and substitute --0554205A1--.

In the Claims

Col. 14,

In claim 7, line 5, delete "related" and substitute --rotated--.

In claim 14, line 3, delete "grid" and substitute --grip--.

Col. 16,

In claim 30, line 1, delete "19" and substitute --29--.

Signed and Sealed this

Fifteenth Day of July, 1997

Bruce Lehman

*Attest:*

BRUCE LEHMAN

*Attesting Officer*

*Commissioner of Patents and Trademarks*